United States Patent [19]

Williams, Jr.

[11] 4,198,887

[45] Apr. 22, 1980

[54] JULIENNE CUTTER TOOL

[75] Inventor: William A. Williams, Jr., Danbury, Conn.

[73] Assignee: Wilson Research & Development, Inc., Greenwich, Conn.

[21] Appl. No.: 874,655

[22] Filed: Feb. 2, 1978

[51] Int. Cl.[2] ..... B26D 3/26

[52] U.S. Cl. ..... 83/356.3; 83/592; 241/92

[58] Field of Search ..... 83/356.3, 355, 592; 241/92

[56] References Cited

U.S. PATENT DOCUMENTS

| | | | |
|---|---|---|---|
| 419,364 | 1/1890 | Schoell | 83/356.3 |
| 2,035,339 | 3/1936 | Powers | 83/356.3 |
| 2,834,386 | 5/1958 | Heininger | 83/592 X |
| 3,783,727 | 1/1974 | Brignard et al. | 83/592 |
| 3,892,365 | 7/1975 | Verdun | 241/92 |
| 3,985,304 | 10/1976 | Sontheimer | 241/92 |

FOREIGN PATENT DOCUMENTS

| | | | |
|---|---|---|---|
| 2354683 | 2/1978 | France | 83/356.3 |

*Primary Examiner*—Frank T. Yost

*Attorney, Agent, or Firm*—Parmelee, Johnson, Bollinger & Bramblett

[57] ABSTRACT

A julienne cutter tool and method of making are described, the cutter being intended for use in rotary food processing apparatus of the type having an upright working bowl with a vertical motor-driven tool shaft extending up into the bowl. The julienne cutter has a hub engageable with said tool shaft for rotating a horizontal disc-like member carrying a primary blade horizontally positioned at an elevated location above the upper surface of said disc member and extending from a smaller radius region to a larger radius region. An opening defined by said disc member permits the food material which has been cut by said primary blade to move downwardly through the disc member, and a plurality of individual radially-spaced secondary blades located in said opening in respective planes perpendicular to said primary blade neatly slice the food material into julienne strips. These secondary blades are formed by slitting a strip of sheet blade metal for providing a plurality of tabs integrally attached to a planer base portion of the blade strip and then bending each tab perpendicular to the plane of said base portion and sharpening each tab, said base portion being attached to said disc member with said sharpened tabs extending into said opening for providing the secondary blades.

7 Claims, 6 Drawing Figures

JULIENNE CUTTER TOOL

FIELD OF THE INVENTION

The present invention relates to apparatus for preparing food, and in particular to a novel tool for multipurpose food processors for kitchen use in which various rotary food preparing tools, including tools such as cutters, slicing discs, rasping discs, grating discs, etc. are interchangeably mounted for performing the different operations of cutting, slicing, rasping, or grating of food items as may be desired by a user. In particular the invention relates to a conveniently removable julienne cutter which can be mounted on the tool shaft of a food processor for neatly cutting and slicing food material into julienne strips.

BACKGROUND OF THE INVENTION

There is food processing apparatus of the type broadly set forth above called a food processor and having a working bowl or vessel with a motor-driven shaft projecting vertically upwards through the bottom of the bowl. Various selected rotary tools can be engaged on and driven by the shaft for performing many different food processing operations as may be desired by the user. A detachable cover is secured over the top of the bowl during use. This cover includes a hopper or feed tube which has a mouth that opens downwardly through the cover into the top of the bowl. The food items to be prepared may be placed in this feed tube and then are manually pushed down through the feed tube ino the bowl by means of a removable pusher member which is adapted to slide down into this feed tube in the manner of a plunger. For further information about this type of food preparing apparatus the reader may refer to U.S. Pat. No. 3,892,365 of Pierre Verdun and U.S. Pat. No. 3,985,304 of Carl G. Sontheimer.

The interchangeable rotary tools which may be used in a food processor include slicing discs, rasping discs, grating discs, etc. which have a disc-like cutting tool member formed of sheet metal, preferably stainless steel, with one or more cutting elements projecting above the upper surface of the cutting disc member. These tools which have a disc-like cutting member are intentionally positioned in the top of the bowl near the lower surface of the cover where they can cut, slice, rasp, or grate the food items entering downwardly from the feed tube into the top of the bowl. For the purpose of positioning the disc-like cutting tool member in the top of the bowl, such a rotary tool may include a relatively long hollow hub extending relatively far down into the bowl, depending upon the height of the motor-driven tool shaft in the bowl. This hollow hub slides vertically down around the upper end of the tool shaft. In order to provide a driving connection between the shaft and this hollow hub, the shaft is formed with driving coupling means, such as a flat face, keyway or spline, and the hollow hub has complementary coupling means, such as internal lugs, keys, or grooves for engaging the shaft. Thus, each of the various disc-like cutting tools can be engaged quickly and easily with the shaft in a positive driving relationship and also can be removed quickly and conveniently to be replaced by another.

One type of food preparation is the cutting of food material, such as a potato, into julienne strips. The cutting of a potato into such strips of small rectangular cross section requires that it be sliced in two perpendicular planes. The slicing disc of the prior art as shown in said Verdun and Sontheimer patents has a single, horizontal blade spaced above the plane of the disc and is well suited for slicing a potato into slices of uniform thickness. It would, of course, be possible to remove the potato slices from the working bowl and then manually to cut these slices into small strips by using a sharp knife, but this would defeat one of the major advantages of the food processor, which is to perform each desired preparation quickly and accurately in a short time cycle. For a number of years the food processor industry has been needing and lacking a strong, reliable, readily fabricated julienne cutter.

SUMMARY OF THE INVENTION

This invention is an improved tool for use in rotary food processing apparatus of the type having an upright, working bowl with a vertical motor-driven shaft extending up into the bowl and a cover closing the top of the bowl when in use. The cover has a manual feed passage through which food items may be introduced into the top of the bowl. A rotary tool for processing these food items has a hub which removably engages the drive shaft in driven relationship therewith with a horizontal disc-like member secured to the hub for rotation therewith. The disc-like member carries a primary blase which is at an elevated location spaced above the upper surface of the disc-like member and extends from a smaller radius region to a larger radius region. The disc-like member defines an opening which underlies and is aligned with the primary blade. The julienne cutter tool of the present invention includes a multiplicity of individual radially-spaced secondary blades located in the opening in respective planes perpendicular to the primary blade for neatly slicing the food material cut by the primary blade into julienne strips during each revolution of the cutter tool. The individual spaced secondary blades are formed by slitting a strip of sheet blade metal for providing a plurality of tabs integrally attached to a planar base portion of the blade strip. Each tab is then bent perpendicular to the plane of said base portion and is sharpened to form the individual blade. The base portion of said strip is attached to the disc member with the sharpened blades extending into the opening along planes perpendicular to the primary blade for forming the secondary blades.

The various features, aspects, and advantage of this invention will become more fully understood from a consideration of the following description when considered in conjunction with the accompanying drawings.

DESCRIPTION OF THE PREFERRED EMBODIMENT

Figure 1:
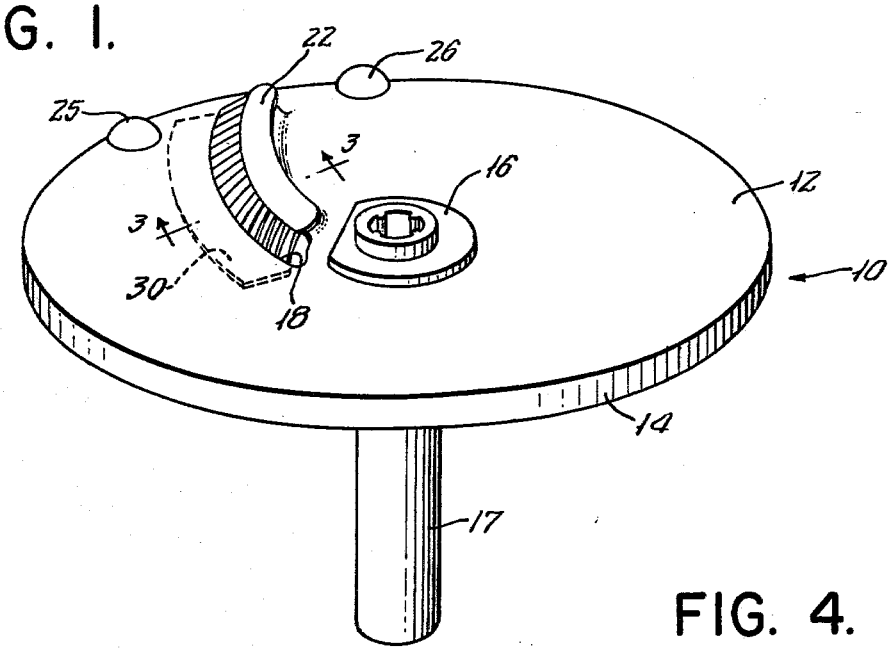
FIG. 1 is a perspective view of a rotary julienne cutter food processing tool embodying the present invention.

With reference to the drawings, there is illustrated in FIG. 1 a julienne cutter tool 10 in the form of a disc-like member 12 of stainless steel having a depending peripheral skirt 14. The disc 12 is mounted on a hub 16 which is engageable with the tool drive shaft (not shown) of a food processor. As explained in the introduction this tool drive shaft extends up into an upright working bowl of the food processor. Depending upon the length of this tool drive shaft and upon the height of the working bowl, the hub 16 may include a relatively long hollow hub portion 17 which extends down for reaching and engaging with the tool drive shaft. The disc 12 defines an arcuate slot 18 (FIGS. 1 and 3) which extends from a small to a larger radius portion of the disc.

Figure 3:
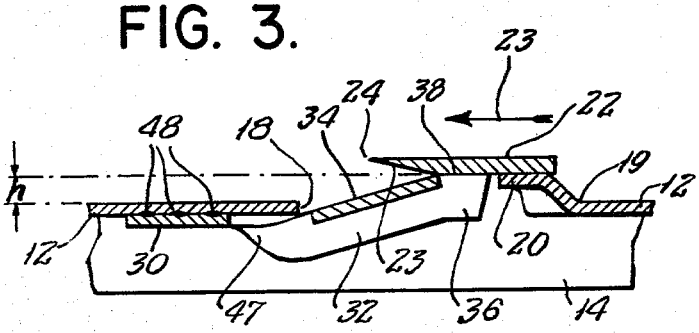
FIG. 3 is an enlarged cross-section taken substantially along the line 3—3 of FIG. 1.

As shown in FIG. 3, the disc 12 is bent upwardly along the trailing edge of the slot 18, relative to the direction of rotation of the tool 10, to form a raised shoulder 20 extending parallel with the plane of the disc-like member 12. The top surface of this shoulder 20 is at an elevated location "h" above the top surface of the disc member 12. Secured upon this shoulder 20 as by welding is a horizontal primary knife 22 which is shaped to overlie the slot 18. The slot opening 18 has an arcuate configuration as seen in plan view most clearly in dash and dotted outline in FIG. 4 commencing near the hub 16 and sweeping radially outwardly and rearwardly with respect to the direction of rotation, indicated by the arrows 23 in FIGS. 3 and 4. The primary blade 22 is also arcuate in configuration and projects forwardly from its mounting shouler 20 so as to be aligned with the arcuate slot 18.

As shown in FIG. 3 the lower surface of the primary blade 22 is ground away at 23 to provide the sharpened cutting edge 24 which overlies and is elevated above the opening 18. The disc 12 also may include one or two raised humps 25, 26 which function to keep the knife 22 from inadvertent engagement with the lower surface of the nearby lid of the processor as explained in U.S. Pat. No. 3,985,304 mentioned above.

Figure 2:
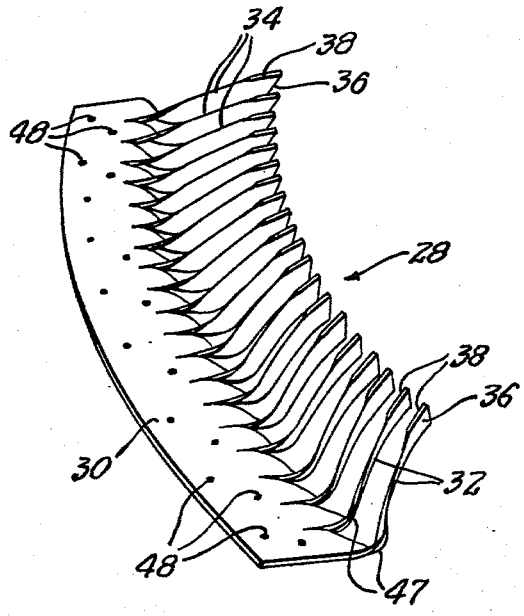
FIG. 2 is an enlarged perspective view of a portion of the tool of FIG. 1.

The structure described thus far comprises a conventional slicing tool capable of slicing an article of food such as a potato. In order to provide the additional capability of forming julienne strips, there is added thereto the multiple-bladed cutter structure 28 shown in FIG. 2. This cutter structure 28 includes a planar base portion 30 arcuately curved to match the curve of the slot 18 with a plurality of upwardly extending knives 32, each having a sharpened upper leading edge 34 and terminating at its distal end at a substantially rectangular finger 36 having an elevated horizontal shoulder edge 38 as shown in FIG. 3.

Each of these knives 32 describes a compound curve such that, when installed as hereinafter described, it will make a substantially vertical cut through the food being processed, i.e., perpendicular to the cut made by the edge 24 of the primary blade 22. The spacing between the respective individual knife blades 32 is approximately equal to the height "h" of the bottom of the primary blade 22 above disc 12 (FIG. 3).

Figure 4:
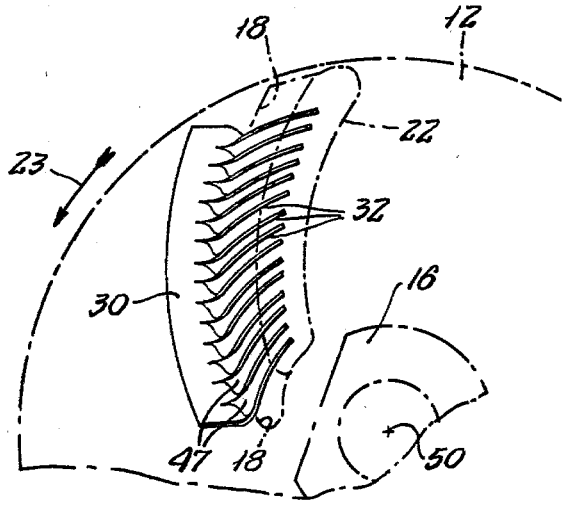
FIG. 4 is a top plan view of the julienne cutter of FIG. 1 with the disc-like member and primary blade shown dash and dotted to reveal the interrelationship between the primary and secondary blades.
Figure 5:
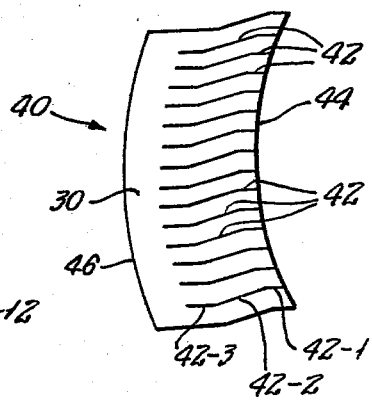
FIG. 5 is a top view of a blank of sheet blade metal from which the cutter element of FIG. 2 is formed.

The cutter structure 28 is advantageously formed from an arcuate blank 40 as shown in FIG. 5. This blank 40 is preferably of stainless steel sheet suitable for sharpening into knife blades and includes a plurality of slits 42 which extend inwardly approximately perpendicular from the concave edge 44 of the blank 40 approximately three fourths of the distance to the convex edge 46. As shown in FIG. 5 each slit 42 has a staggered shape including first and third slit portions 42-1 and 42-3, which are offset from each other but are generally parallel with each other and a diagonal intermediate portion 42-2 which joins them. Each of the tabs formed by these slits 42 is twisted, adjacent to its juncture with the base portion 30, as shown at 47 in FIGS. 2, 3 and 4, and its distal end is raised into the position shown most clearly in FIGS. 2 and 3, and ground to form the sharpened edge 34. The curvature of each blade 32 is preferably such that, when installed in the tool 10, it lies along a cylinder concentric with the axis of rotation 50 of the disc 12.

The cutter structure 28 is installed in the cutting tool 10 by positioning the planar base portion 30 beneath the disc 12 immediately in front of the leading edge of the arcuate slot 18 and aligned with this slot. When the planar base portion 30 is installed in this portion, as shown in FIG. 3, the knives 32 extend upwardly through the slot 18 with their shoulder edges 38 positioned against the lower surface of the primary knife 22. The cutter element 28 is then secured to the disc 12 by means of a plurality of spot welds 48 to form a rigid assembly. The horizontal shoulder edges 38 of the ends of blades 32 seat up against the undersurface of the primary blade immmediately behind the ground off region 23.

It will now be seen that there has been provided a julienne cutter tool 10 which has both a raised horizontal primary knife 22 for cutting slices through a food article and a plurality of radially spaced knives 32 positioned to slice the food along radially spaced planes perpendicular to the primary knife to form julienne strips of substantially rectangular cross section.

Although the radially spaced blades 32 are described as producing slices along radially spaced planes perpendicular to the primary knife 22, it will be appreciated that in the presently preferred arrangement as shown the individual blades 32 are twisted to be perpendicular to the plane of the planar base portion 30 and then are bent along curves, as seen most clearly in FIG. 4, which are portions of circular cylinders concentric about the axis of rotation 50 of the disc-like member 12. If desired for ease of fabrication, each of the blades 32 may be formed without bending into the cylindrical configuration as seen in FIG. 4. Then each individual blade will include a straight portion which is oriented generally tangential to a circular cylindrical surface concentric about the axis 50.

The term "radially spaced secondary cutting blades oriented generally perpendicular to the primary blade" is intended to be interpreted to include any similar minor variations in the actual configuration of each of these blades 32 extending within the arcuate opening 18 for producing multiple cuts in food material such as potato generally perpendicular to the cut produced by the edge 24 of the primary blade 22 for producing neatly cut julienne strips.

Figure 6:
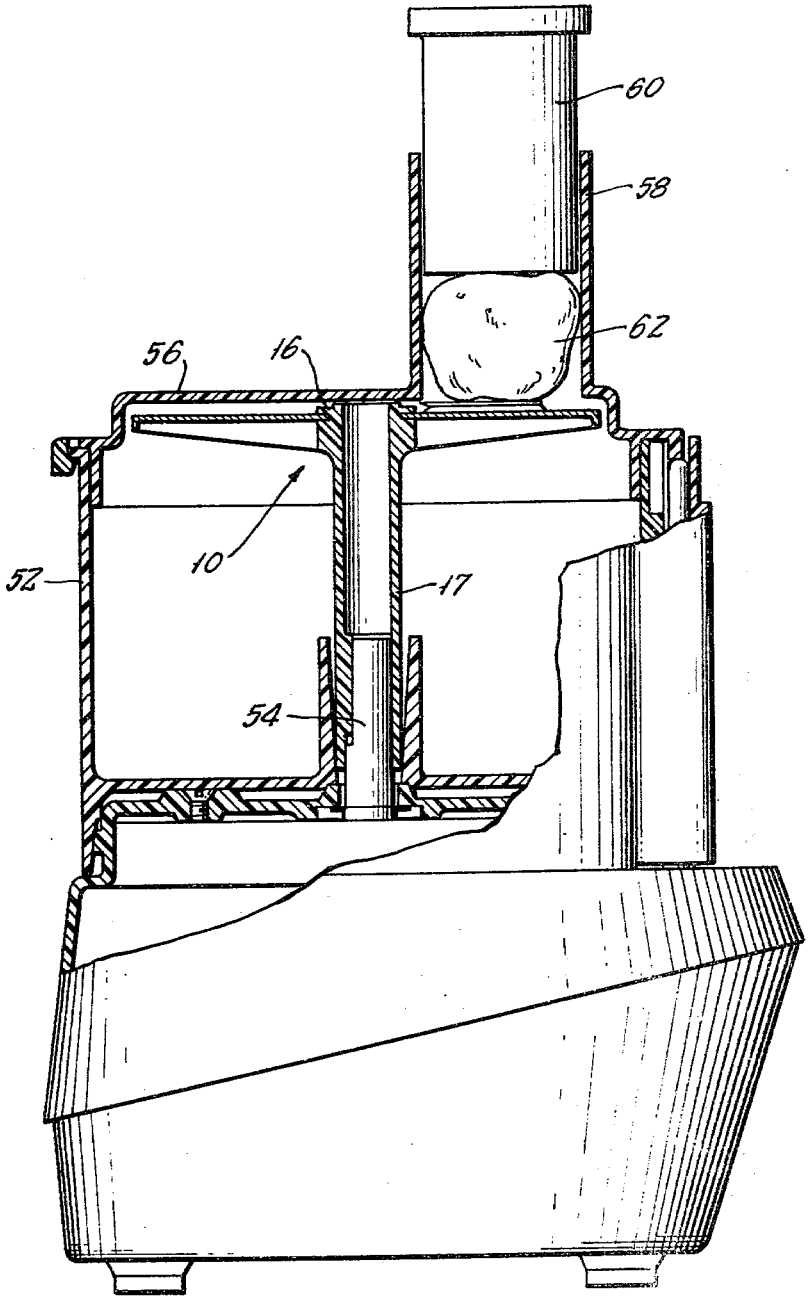
FIG. 6 is an elevational view, shown partly in section of a food processor.

FIG. 6 shows a food processor including an upright working bowl 52 with a motor-driven tool shaft 54 extending into the bowl. A removable cover 56 closes the bowl when in use, and there is a feed passage or feed tube 58 through said cover for introducing food material into the bowl. A removable pusher member 60 is adapted to slide down into this feed tube in the manner of a plunger as described further above for pushing food items 62. The rotary tool 10 is positioned near the cover and has its long hub portion 17 removably engaged upon the tool shaft 54 for rotation by the shaft. Thus, food items 62 introduced through the feed tube 58 are cut by the julienne cutter tool 10.

It will also be apparent to those skilled in the art that a number of variations and modifications may be made in the julienne cutter tool of this invention without departing from the spirit and scope of the invention. Accordingly, the foregoing description is to be construed as illustrative only, rather than limiting. This invention is limited only by the scope of the following claims.

I claim:

1. In rotary food processing apparatus for processing food material having an upright working bowl with a motor-driven tool drive shaft extending into the bowl, a removable cover for closing the bowl when in use, and a feed passage through said cover for introducing food material into the bowl, in which a rotary tool is used in the bowl having a hub removably engageable with said drive shaft to be rotated thereby in a predetermined direction of rotation about an axis and with a disc-like member secured to the hub for rotation therewith, said disc-like member having cutting means thereon in the form of a primary blade positioned at an elevated location relative to the upper surface of said disc-like member, said primary blade extending from a smaller radius region to a larger radius region relative to the hub, said primary blade having a sharp leading edge which sweeps rearwardly with respect to the direction of rotation of said disc-like member about said axis, and with an opening defined by said disc-like member generally aligned with said primary blade and sweeping rearwardly like said primary blade for accommodating the passage of cut food material through said opening, said opening having a leading edge which is forward of the cutting edge of said primary blade with respect to said direction of rotation, the improvement for making julienne strips which comprises:

an elongated strip of metal mounted below said disc-like member, said elongated strip sweeping rearwardly in conformance with the cutting edge of said primary blade, a plurality of radially spaced secondary cutting blades extending upwardly from and being integral with said elongated strip, said secondary cutting blades being radially spaced with respect to said axis and each being oriented concentric about said axis, each of said secondary cutting blades having a sharp leading edge, and the upper ends of said secondary cutting blades being positioned close to said primary blade for producing cuts in food material substantially perpendicular to the cut produced by said primary blade for making julienne strips from food material.

2. In rotary food processing apparatus in which said primary blade is arcuately curved extending outwardly and rearwardly with respect to the direction of rotation of said disc-like member and said opening defined by said disc-like member is similarly arcuately curved, the improvement as claimed in claim 1 for making julienne strips in which:

said elongated strip of metal is arcuately curved to match the curve of said primary blade, said elongated strip of metal is positioned ahead of the cutting edge of said primary blade with respect to the direction of rotation about said axis, said secondary cutting blades extend upwardly from an edge of said elongated strip, and each blade is bent relative to said elongated strip at the juncture between the respective blade and said strip for orienting each respective blade concentric about said axis.

3. In rotary food processing apparatus, the improvement as claimed in claim 1 or 2 for making julienne strips in which:

the sharp leading edge of each secondary cutting blade slopes rearwardly in an upward direction with respect to the direction of rotation about said axis.

4. A julienne cutter tool for use in a rotary food processor of the type having an upright working bowl with a motor-driven tool drive shaft extending into the bowl with a removable cover for closing the bowl when in use, and a feed passage through said cover for introducing food material into the bowl, said julienne cutter tool having a hub removably engageable with said drive shaft to be rotated thereby with a disc-like member secured to the hub for rotation therewith, said disc-like member having cutting means thereon in the form of a primary blade spaced at an elevated location relative to said disc-like member, said primary blade extending from a smaller radius region to a larger radius region relative to said hub, and with an opening defined by said disc-like member generally aligned with said primary blade for accommodating the passage of cut food material through said opening, said julienne cutter tool including the improvement which comprises:

a cutting structure mounted on said disc-like member in association with said opening for producing multiple closely spaced cuts in food material generally perpendicular to the cut produced by said primary blade for making julienne strips, said cutting structure including an elongated portion of sheet metal mounted beneath said disc-like member, said elongated portion of sheet metal extending along near said opening, a plurality of relatively closely spaced secondary blades extending upwardly from an edge of said elongated portion into said opening, each of said secondary blades being integrally attached to said elongated portion and being twisted relative to said elongated portion for orienting a leading edge of each secondary blade in a cutting position, and the upper ends of said secondary blades being positioned close to said primary blade.

5. A julienne cutter tool as claimed in claim 4, in which:

the leading edge of each secondary blade extends upwardly and slopes rearwardly with respect to the direction of rotation of said disc-like member.

6. A julienne cutter tool as claimed in claim 4, in which:

each of said secondary blades is twisted relative to said elongated portion for orienting each blade generally tangential to a circular cylindrical surface concentric about the axis of rotation of said disc-like member.

7. A julienne cutter tool for use in a rotary food processor of the type having an upright working bowl with a motor-driven tool drive shaft extending into the bowl with a removable cover for closing the bowl when in use, and a feed passage through said cover for introducing food material into the bowl, said julienne cutter tool having a hub removably engageable with said drive shaft to be rotated thereby with a disc-like member secured to the hub for rotation therewith, said disc-like member having cutting means thereon in the form of a primary blade spaced at an elevated location relative to said disc-like member, said primary blade being arcuately curved and extending outwardly parallel with said disc-like member and curving rearwardly with respect to the direction of rotation about said hub, and with an opening defined by said disc-like member being similarly curved and being generally aligned with said primary blade for accommodating the passage of cut food material through said opening, said julienne cutter tool including the improvement which comprises:

an elongated strip of metal arcuately curved to match the curve of said primary blade, said arcuately curved elongated strip being mounted below said disc-like member, a plurality of radially spaced secondary blades oriented perpendicular to said primary blade and integrally attached to said arcuately curved elongated strip and projecting upwardly from an edge of said elongated portion through said opening, and the upper ends of said secondary blades being positioned close to said primary blade for cutting food material into neatly cut julienne strips.

* * * * *